US010617967B1

(12) United States Patent
Oxenford et al.

(10) Patent No.: US 10,617,967 B1
(45) Date of Patent: Apr. 14, 2020

(54) CONCEALABLE MULTIPLE BLADE DEVICE

(71) Applicants: Robert G. Oxenford, Jackson, GA (US); Mikki Bradley, Jackson, GA (US)

(72) Inventors: Robert G. Oxenford, Jackson, GA (US); Mikki Bradley, Jackson, GA (US)

( * ) Notice: Subject to any disclaimer, the term of this patent is extended or adjusted under 35 U.S.C. 154(b) by 0 days.

(21) Appl. No.: 15/820,880

(22) Filed: Nov. 22, 2017

(51) Int. Cl.
*A63H 33/00* (2006.01)

(52) U.S. Cl.
CPC ..... *A63H 33/009* (2013.01); *A63H 33/00* (2013.01)

(58) Field of Classification Search
CPC ..... A63H 33/00; A63H 33/009
See application file for complete search history.

(56) References Cited

U.S. PATENT DOCUMENTS 2,895,139 A 7/1959 Compton
3,049,182 A * 8/1962 Pelow ..... A01B 1/04 172/378
3,060,625 A * 10/1962 Glass ..... F41C 9/00 446/26
3,752,524 A 8/1973 Reich
4,096,629 A 6/1978 Levine
5,058,278 A 10/1991 Colvin
5,286,228 A * 2/1994 Lee ..... A63H 33/00 294/106
5,325,596 A 7/1994 Baker
5,722,169 A * 3/1998 Ozden ..... F41B 13/00 30/162
10,264,872 B2 * 4/2019 Kim ..... B25F 1/003
2007/0218803 A1 * 9/2007 Tong ..... A63H 33/009 446/473
2010/0236077 A1 9/2010 Shirey et al.
2014/0214042 A1 * 7/2014 Cleveland ..... A61B 17/1617 606/83
2015/0352732 A1 * 12/2015 Levine ..... B26B 1/08 30/151

OTHER PUBLICATIONS

Le FabShop Wolverine Claws. Product listing [online]. LeFabShop [published by Oct. 26, 2015] Retrieved from the Internet: <URL: https://www.thingiverse.com/thing:1093632>.
How to make Paper Wolverine Claws that Work | OTF (out the front) Claws. Video [online]. LXG Design [published on Sep. 5, 2015]. Retrieved from the Internet: <URL: https://www.youtube.com/watch?v=jL6qcv3u37A>.

* cited by examiner

*Primary Examiner* — Eugene L Kim
*Assistant Examiner* — Alyssa M Hylinski
(74) *Attorney, Agent, or Firm* — Cramer Patent & Design, PLLC; Aaron R. Cramer

(57) ABSTRACT

A concealable multiple blade device uses a frame with a pair of fasteners configured to secure about the wrist of a user. Within the frame are disposed a plurality of blades which are capable of slidingly being projected outside of the frame without leaving the frame entirely.

3 Claims, 5 Drawing Sheets

CONCEALABLE MULTIPLE BLADE DEVICE

RELATED APPLICATIONS

Not applicable.

FIELD OF THE INVENTION

The present invention relates generally to the field of deployable faux blades wearable about an arm.

BACKGROUND OF THE INVENTION

Halloween is a day of great fun for both adults and children alike. There are parties to attend, decorations to put up, scary stories to tell, and so forth. But no matter how many activities one participates in, the act of getting dressed up in a costume is typically a common one Every year new costumes hit the scene driving the marketing craze. Unfortunately, just as soon as such costumes arrive, they fade just as quickly leaving customers in a search for the next "hot" costume that catches attention before it becomes commonplace. Of course, manufacturers are on the search for exactly the same thing in an effort to capitalize on the next craze before the market becomes saturated with competitors. Accordingly, there exists a need for a means by which unique Halloween novelty costume items can be developed to satisfy customers and manufacturer demands alike. The development of the novelty concealable multiple blade device fulfills this need.

Various attempts have been made to solve problems found in concealed blade deployable devices. Among these are found in: U.S. Pat. No. 5,058,278 in the name of Colvin and U.S. Pat. No. 5,325,596 in the name of Baker. These prior art references are representative of concealed blades for personal defense and not representative of simulated blades or the purposes of entertainment. Other prior art includes deployable simulated claws or blades, but they deploy in a different manner and are not concerned with concealment.

SUMMARY OF THE INVENTION

In order to provide a device such a desired entertaining deployable concealed blade device, the object of the present invention provides for an arm box, configured to secure to an arm of a user, having a first side wall, a second side wall, a distal end wall affixed to and spanning a distance between distal ends of the first and second side walls, and a proximal end wall affixed to and spanning a distance between proximal ends of the first and second side walls. A plurality of openings is located at the proximal end wall. A plurality of blades is provided, each having a first end disposed within the arm box and a second end. Each of the second ends at least partially protrudes through a respective one (1) of the plurality of openings. A plurality of spacer blocks is also provided, each being affixed between adjacent blades and adjacent to first ends thereof. Further, a pair of connection rods are provided, each affixed to and passing through the blades and spacer blocks. During deployment or retraction, the spacer blocks, connection rods, and first ends of the blades travel between the distal end wall and the proximal end wall. In a preferred embodiment, the blades are oriented so as to enable an individual blade to emerge between adjacent fingers of the user when deployed. In a preferred embodiment, three (3) blades, three (3) openings, and two (2) spacer blocks are provided.

In order to secure the device to the user, at least one (1) strap is each affixed to the arm box and capable of being removably fastened to itself. In a preferred embodiment, a first strap is affixed to the first side wall adjacent to the proximal end wall and a second strap is affixed to the first side wall adjacent to the distal end wall. The first strap is capable of securing to a wrist of the user and the second strap is capable of securing to the forearm of the user. In certain embodiments, an offset spacer is affixed between the first strap and the first side wall.

Another object of the present invention is to provide that the blades are fabricated out of a soft semi-flexible plastic material. In some embodiments, the first ends of the blades are weighted.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
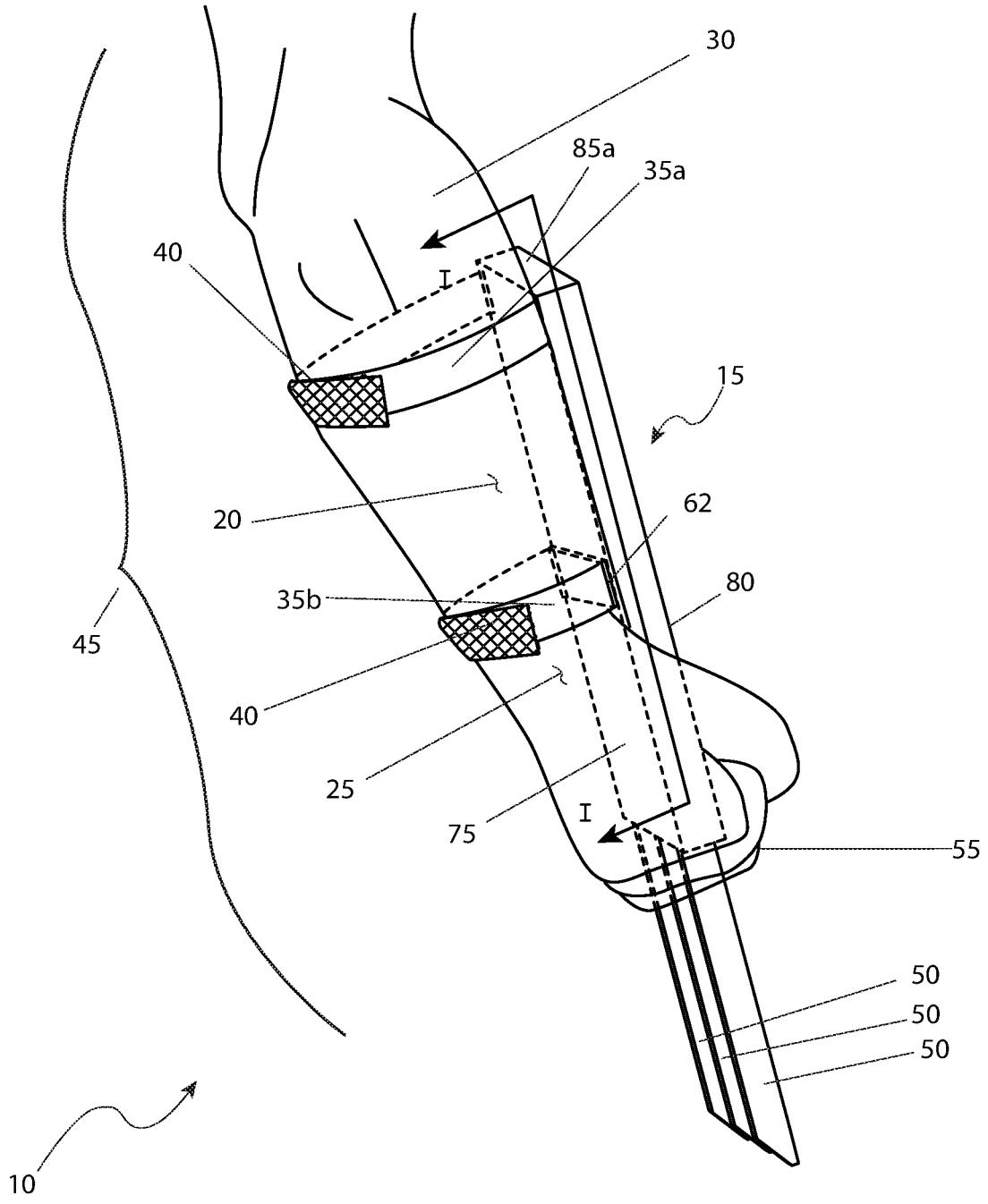
FIG. 1 is a perspective view of the novelty concealable multiple blade device 10, shown in use in an extended position the preferred embodiment of the present invention.

10 novelty concealable multiple blade device
15 arm box
20 forearm
25 wrist area
30 user
35*a* forearm attachment strap
35*b* wrist attachment strap
40 adjustable fastener
45 arm
50 faux blade
55 finger
56 palm
60 spacer block
62 offset spacer
65 connecting rod
70 first fastener
75 first sidewall
80 second sidewall
85*a* first end wall

85*b* second end wall
90 second fastener
95 opening

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

Referring now to FIG. 1, a front view of the novelty concealable multiple blade device 10, according to the preferred embodiment of the present invention is disclosed. The novelty concealable multiple blade device 10 (herein also described as the "device") 10, includes an arm box 15 that fits against the forearm 20 and wrist area 25 of a user 30. The arm box 15 is held in place with a minimum of two (2) attachment straps 35*a*, 35*b* that are held in place with an adjustable fastener 40 such as hook and loop fastener (Velcro®). It is envisioned that the attachment straps 35*a*, 35*b* are made of leather, nylon or similar material. For purposes of clarity, only one (1) arm 45 is shown; however, it is inferred that the device 10 may be worn on the right, left, or both arms 45, when used in pairs. Additionally, due to the novelty nature of the device 10 and its ability to create surprise or fright, it is anticipated that the arm box 15 and the attachment straps 35*a*, 35*b* would normally be covered by a long sleeve garment (not shown for purposes of illustration) such as a shirt or jacket with loose fitting cuffs.

The arm box 15 is generally an open structure having a pair of parallel first sidewalls 75, each having a first end and a second end and a pair of parallel second sidewalls 80, each having a first end and a second end. The first ends of each sidewall 75, 80 are conjoined via a first end wall 85*a*. Similarly, the second ends of each sidewall 75, 80 are conjoined via a second end wall 85*a*. The first end wall 85*a* is parallel with the second end wall 85*b*. The first sidewalls 75, second sidewalls 80, and end walls 85*a*, 85*b* form the arm box 15. The first end wall 85*a* for purposes of description will be located on the forearm 20 of the arm 45 of the user 30 while the second end wall 85*b* will be located at the palm 56 of the user 30 when the device 10 is worn.

The forearm attachment strap 35*a* will be affixed to the device 10 adjacent the first end wall 85*a* and the wrist attachment strap 35*b* will be affixed to the device 10 adjacent the second end wall 85*a*. In a preferred embodiment, the forearm attachment strap 35*a* is affixed directly on the one (1) of the first sidewalls 75 directly adjacent to the first end wall 85*a* whereas the wrist attachment strap 35*b* is also affixed to the same first sidewall 75 as the forearm attachment strap 35*b*, but located at a more intermediate location and more distant from the second end wall 85*b*.

During actuation or activation of the device 10 three (3) faux blades 50 exit from the distal end of the arm box 15 and align themselves to emerge through the fingers 55 of the user 30. It is noted that the faux blades 50 are made from soft semi-flexible plastic or similar material so as to not pose a physical stabbing and/or cutting danger to the user 30 or others. Each faux blade 50 is approximately three-quarters of an inch (¾ in.) wide and extend outward approximately eight inches (8 in.) from the fingers 55 area when fully extended. The proximal end of the faux blades 50 (still retained within the arm box 15) are weighted to aid in the automatic extension and retraction of said faux blades 50. Such weighted features can include additional cladding, affixed or removably attached weights, thicker material at that section, or similar means. When the user 30 places their arm 45 in the downward position, the faux blades 50 slide from the arm box 15 by the force of gravity. This extension motion can be stopped or controlled by placement of the fingers 55 over the faux blades 50 to stop extension, or slid in between the faux blades 50 to control speed of advancement. As such, the user 30 has complete control of the faux blades 50, in any position, by gravity. It is envisioned that the device 10 would be made in one (1) standard size for use by both children and adults of either sex. However, specialized sizes with faux blades 50 of varying sizes and designs are also within the teachings of the present invention, and as such, should not be interpreted as a limiting factor of the present invention.

Figure 2:
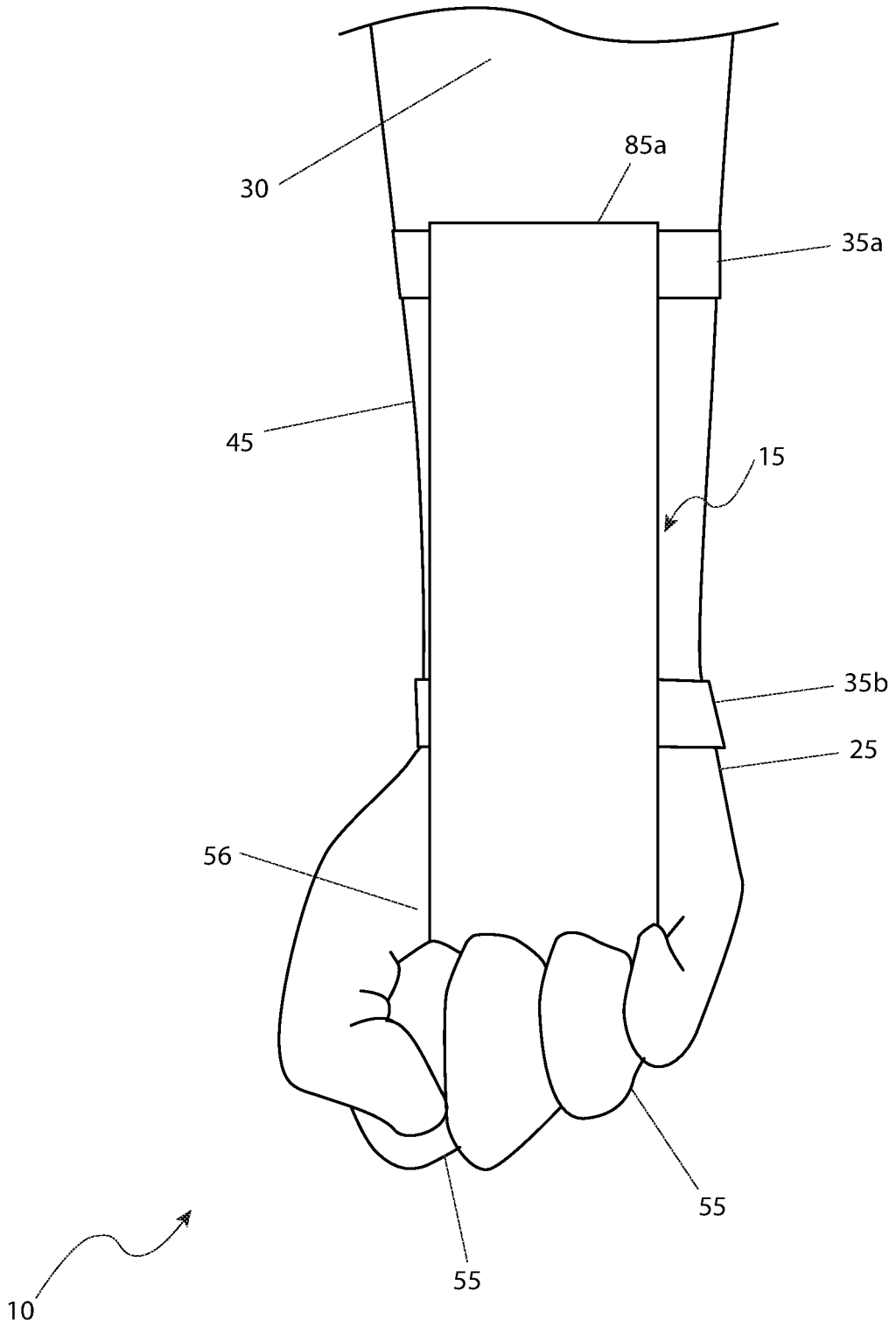
FIG. 2 is a perspective view of the novelty concealable multiple blade device 10 shown in use and in a retracted position, according to the preferred embodiment of the present invention.
Figure 5:
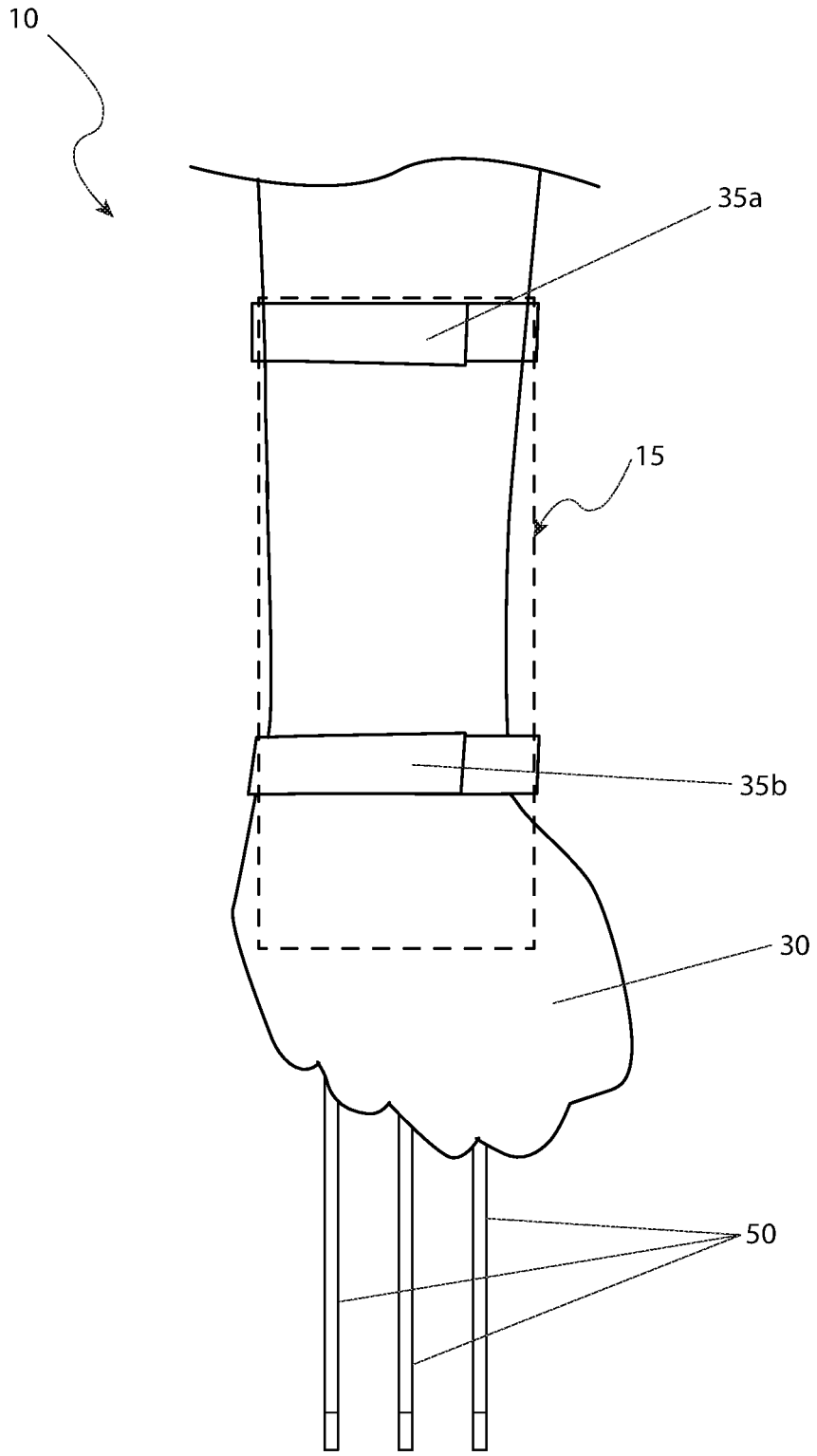

Referring next to FIG. 2, a perspective view of the device 10 shown in use and in a retracted position, according to the preferred embodiment of the present invention is depicted. This figure depicts the faux blades 50 (as shown in FIG. 1) completely retracted and contained within the arm box 15. The retraction process occurs when the user 30 places their arm 45 in the upward position, the faux blades 50 (as shown in FIG. 1) slide into the arm box 15 by the force of gravity. This retraction motion can be stopped or controlled by placement of the fingers 55 in between the faux blades 50 (as shown in FIG. 1) and using inward pressure (squeezing of fingers 55) to control speed of retraction. Should the user 30 wish to place their hand in the downward position without deploying the faux blades 50 (as shown in FIG. 1), they would angle the wrist area 25 to cover the distal end of the arm box 15 or place one (1) or more fingers 55 over one (1) or more of the faux blades 50 (as shown in FIG. 1) to prevent deployment. In the fully closed (retracted) position, the faux blades 50 remain exposed for a total dimension of approximately one-half inch (2 in.), so as to provide complete control. It is appreciated that when the device 10 is properly positioned in place on the arm 45 of the user 30, the faux blades 50 are completely concealed when the fingers 55 are curled up against the device 10 and palm 56 of the user 30. As aforementioned described, the concealment of the device 10 is accomplished by a long-sleeved garment so as to be discrete and not arouse suspicion amongst bystanders. FIG. 5 illustrates how the device 10 would look from the front, showing the location of the faux blades 50 as they are protruding between the fingers 55 of the user 30.

Figure 3:
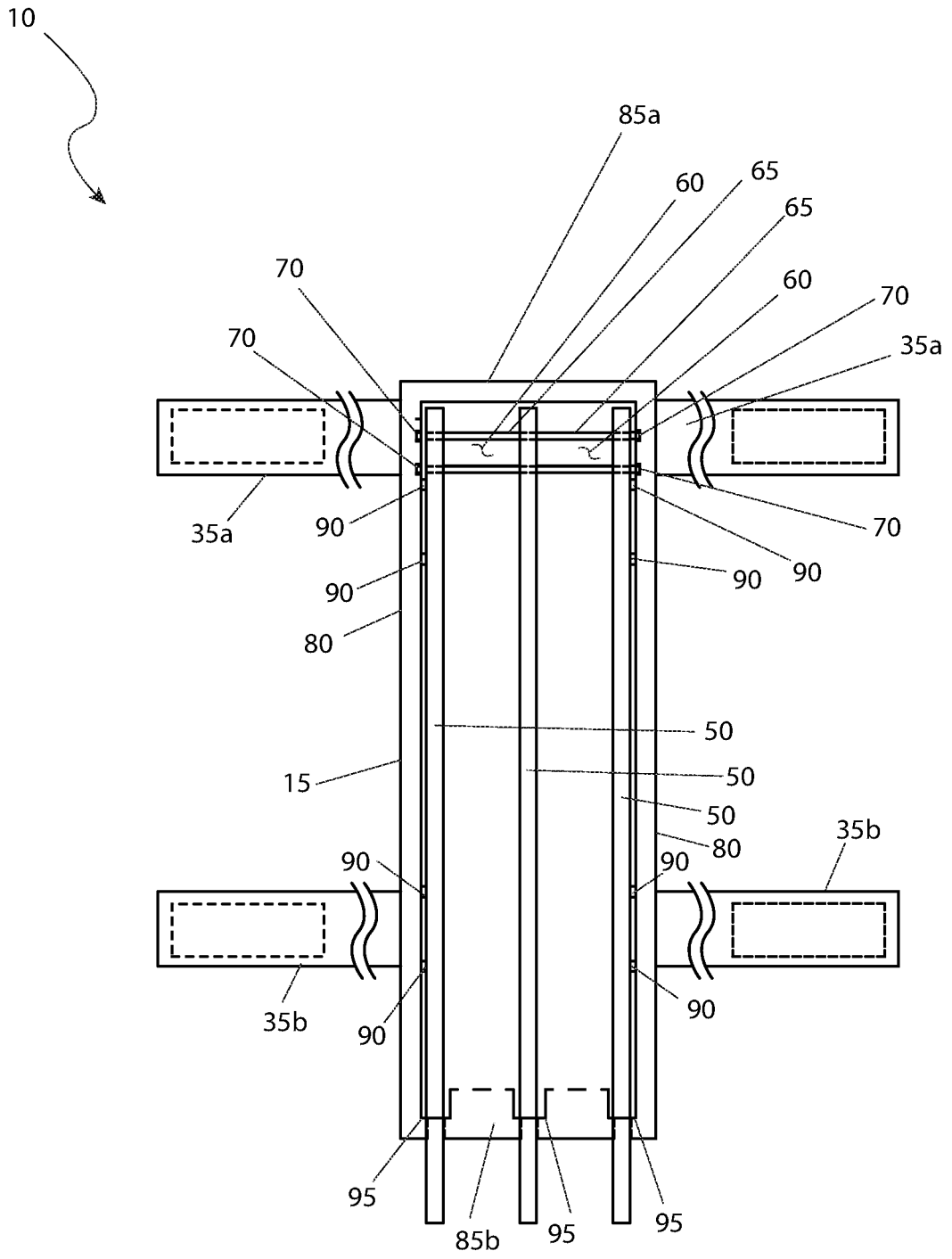
FIG. 3 is a sectional view of the novelty concealable multiple blade device 10, as seen along a line I-I, as shown in FIG. 1, while in a retracted state, according to the preferred embodiment of the present invention.

Referring now to FIG. 3, a sectional view of the device 10, as seen along a line I-I, as shown in FIG. 1, while in a retracted state, according to the preferred embodiment of the present invention is shown. The faux blades 50 are connected together at their proximal end with the use of two (2) spacer blocks 60 that provide approximately one inch (1 in.)

spacing between each faux blade 50. Two (2) connecting rods 65 are routed through each of the faux blades 50 and the spacer blocks 60 and are connected with first fasteners 70 such as washers, nuts, pressed fittings, or the like. The attachment straps 35*a*, 35*b* are attached to the arm box 15 by use of second fasteners 90 such as rivets. The second end wall 85*b* (located near the wrist area 25 as shown in FIG. 1) is provided with three (3) openings 95 through which the faux blades 50 may exit. When the faux blades 50 are fully retracted, the terminal end of each faux blade 50 protrudes through a respective opening 95. Therefore, when the faux blades 50 are deployed, the partial engagement of each faux blade 50 with a respective opening 95 allows the plurality of faux blades 50 to simultaneously travel through the respective openings 95. When the faux blades 50 extend, the spacer blocks 60 also travel until they abut the inner surface of the second end wall 85*b*, thereby limiting further extension.

Figure 4:
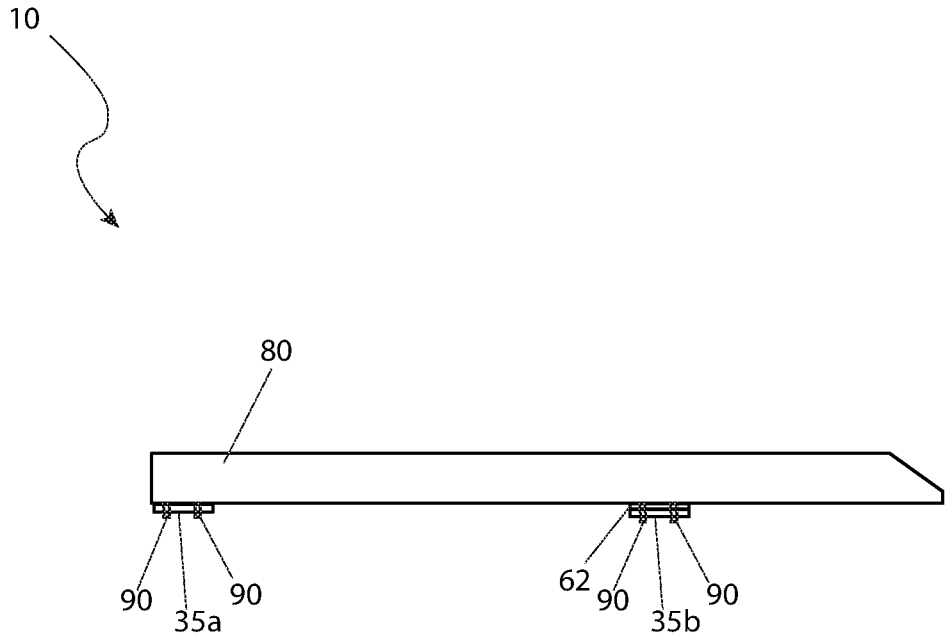
FIG. 4 is a sectional view of the novelty concealable multiple blade device 10, as seen along a line II-II, as shown in FIG. 3, while in a partially extended state, according to the preferred embodiment of the present invention; and, FIG. 5 is a front view of the novelty concealable multiple blade device 10 shown in use and in an extended position, according to the preferred embodiment of the present invention

Referring finally to FIG. 4, a sectional view of the device 10, as seen along a line II-II, as shown in FIG. 3, while in a partially extended state, according to the preferred embodiment of the present invention is disclosed. An offset spacer 62 is used with each second fastener 90 on the wrist attachment strap 35*b* to provide proper comfort for the wrist 25 of the user 30. It is envisioned that the offset spacer 62 is approximately five-eighths of an inch (%8 in.) in thickness, has a length equal to the width of the arm box 15, and a width generally equal to the width of the wrist attachment strap 35*b*. Additionally, the attachment straps 35*a*, 35*b* and associated second fasteners 90 are visible as well. The second fasteners 90 that attach the wrist adjustment strap 35*b* to the arm box 15 may fully or only partially penetrate the offset spacer 62.

The preferred embodiment of the present invention can be utilized by the common user in a simple and effortless manner with little or no training. It is envisioned that the device 10 would be constructed in general accordance with FIG. 1 through FIG. 4.

The user would procure the device 10 from normal procurement channels. It is envisioned that the arm box 15, the offset spacer 62, the faux blades 50, and the spacer blocks 60 would be made of plastic in an injection molding process. The connecting rods 65 would be made of metal for strength and to add weight to the faux blades 50 to aid in extension (deployment) when the user 30 places their arm 45 in a lowered position. Likewise, the weight associated with the connecting rods 65 within the faux blades 50 will aid in retraction when the user 30 raises their arm 45 when activated upon by gravity.

After procurement and prior to utilization, the novelty concealable multiple blade device 10 would be prepared in the following manner: the user 30 would position the arm box 15 along their forearm 20 and wrist area 25 while holding it in place and securing it in position with the use of the forearm attachment strap 35*a* and the adjustable fastener 40, process is then repeated with wrist attachment strap 35*b* and adjustable fastener 40. Another device 10 is placed on the opposite remaining arm 45 if desired. Finally, a long sleeve garment such as a shirt or jacket is placed over device 10 to limit its visibility to others.

During utilization of the device 10, the following procedure would be initiated: when the user wishes to keep the faux blades 50 in a retracted state, their arm 45 is kept in an upright (hands upward in a vertical or near vertical position) position, or uses their wrist area 25 to limit extension of the faux blades 50. When the arm 45 wishes to surprise or cause fright to others, they will lower their arm 45 thus allowing the effect of gravity to work upon the faux blades 50, the spacer blocks 60 and the connecting rods 65 whereupon they will slide outward and emerge in between the fingers 55 of the user 30. Near silent extension can be accomplished by using the fingers 55 to control the rate of extension by simple inward pressure. The fingers 55 can then be brandished about to cause surprise, humor, fright, or alarm in others depending on other environmental factors. When the user 30 wishes to retract the faux blades 50, they simply raise their arm 45 in an upright (hands upward in a vertical or near vertical position) position allowing the faux blades 50 to glide back in.

After use of the device 10, it is simply removed by manipulation and subsequent disengagement of the adjustable fastener 40 and attachment straps 35*a*, 35*b*, whereupon it is stored until needed again in a cyclical manner.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A concealable blade deploying device, comprising:

an arm box, configured to secure to an arm of a user, said arm box comprising a first side wall, a second side wall, and a distal end wall affixed to and spanning a distance between distal ends of said first and second side walls, and a proximal end wall affixed to and spanning a distance between proximal ends of said first and second side walls, said proximal end wall having a plurality of openings;

a plurality of blades each having a first end disposed within said arm box and a second end, each said second end at least partially protruding through a respective one of said openings;

a plurality of spacer blocks each affixed between adjacent ones of said blades and adjacent to said first ends thereof; and, a pair of connection rods each affixed to and passing through said blades and said spacer blocks;

a pair of straps having a first strap and a second strap, said first strap affixed to said first side wall, said first strap located adjacent said proximal end wall and, said second strap affixed to said first side wall, said second strap located adjacent said distal end wall;

wherein said spacer blocks and said pair of connection rods travel between said distal end wall and said proximal end wall during deployment and retraction;

wherein said blades are oriented so as to enable an individual one of said blades to emerge between adjacent fingers of said user when deployed;

wherein each blade extends outwardly such that said second end terminates eight inches when fully extended from said arm box; and, wherein said first ends of said blades are weighted to aid in the deployment and retraction of said blades, said first ends are weighted by features which include cladding or affixing or removably attaching weights.

2. The device of claim 1, wherein said blades are made out of a soft semi-flexible material.

3. The device of claim 1, further comprising three blades, three openings, and two spacer blocks.

* * * * *